United States Patent [19]

Gagliardo

[11] 4,214,630

[45] Jul. 29, 1980

[54] FIRE FIGHTING NOZZLE

[75] Inventor: John P. Gagliardo, Shrewsbury, Mass.

[73] Assignee: Feecon Corporation, Westboro, Mass.

[21] Appl. No.: 966,113

[22] Filed: Dec. 4, 1978

[51] Int. Cl.[2] ..... A62C 35/00

[52] U.S. Cl. ..... 169/18; 239/526; 251/231

[58] Field of Search ..... 169/15, 16, 14, 18, 169/89, 25; 239/526, 525, 417.5, 413, 549; 251/25, 228, 232, 250.5, 248; 137/597; 254/232, 315, 248, 249.5

[56] References Cited

U.S. PATENT DOCUMENTS

| | | | |
|---|---|---|---|
| 1,007,667 | 11/1911 | Ballard | 239/526 |
| 1,885,258 | 11/1932 | Harris | 169/15 |
| 1,919,616 | 7/1933 | Boyd | 169/15 |
| 2,376,881 | 5/1945 | Nielsen | 239/525 |
| 2,445,163 | 7/1948 | Williamson | 137/139 |
| 2,701,011 | 2/1955 | Bonvillian et al. | 239/417.5 |
| 2,805,037 | 9/1957 | Bruce | 251/25 |
| 2,820,676 | 1/1958 | Cleaves | 239/525 |
| 3,055,629 | 9/1962 | Jurs et al. | 251/25 |
| 3,448,809 | 6/1969 | Lambert et al. | 169/18 |
| 4,030,666 | 6/1977 | Gagliardo | 239/526 |

*Primary Examiner*—Kenneth W. Noland

*Attorney, Agent, or Firm*—Norman S. Blodgett; Gerry A. Blodgett

[57] ABSTRACT

Nozzle for use with two different fire fighting agents, these being a ball valve and an exit tube for each agent.

6 Claims, 3 Drawing Figures

FIRE FIGHTING NOZZLE

BACKGROUND OF THE INVENTION

In fire trucks and similar apparatus, it is common practice to provide a plurality of fire fighting agents that may be used selectively, depending on the type of fire encountered. For instance, in some types of fire it is desirable to use a foam, whereas with other types it is desirable to use a powder. It is desirable to connect these two agents to a common nozzle, so that the selection of agent may be made at the point of use. The operator may wish to use the agents separately, as experience dictates, to extinguish the fire. It is on occasion desirable to use both agents at the same time. My U.S. Pat. No. 4,030,666, which issued on June 21, 1977, shows a construction for performing these functions in response to a trigger mechanism. It is desirable on occasion, however, to provide a very simple construction in which there are no small passages that can clog and interfere with the operation of the equipment and which present very little resistance to the flow of the fire fighting agent. These and other difficulties experienced with the prior art devices have been obviated in a novel manner by the present invention.

It is, therefore, an outstanding object of the invention to provide a nozzle for selective use with two fire fighting agents.

Another object of this invention is the provision of a fire fighting nozzle with two valves and two tubes formed in a single structure.

A further object of the present invention is the provision of a dual agent nozzle which is simple in construction, which is inexpensive to manufacture, and which is capable of a long life of useful service with a minimum of maintenance.

It is another object of the instant invention to provide a dual agent nozzle having valves which present little resistance to the flow of material.

A still further object of the invention is the provision of a fire fighting nozzle in which the valves are so constructed that they may receive the pressure of fire fighting agents continuously and indefinitely without damage.

It is a further object of the invention to provide a dual agent fire fighting nozzle having valve elements that are not easily corroded by the agents used.

It is a still further object of the invention to provide a fire fighting nozzle which can be held by the operator in one hand, while valve selectors are operated easily by the other hand.

It is another object to provide a dual action nozzle having double valves in which the "open" or "closed" condition of each valve is visually indicated by the operating handles.

With these and other objects in view, as will be apparent to those skilled in the art, the invention resides in the combination of parts set forth in the specification and covered by the claims appended hereto.

SUMMARY OF THE INVENTION

In general, the invention consists of a fire fighting nozzle having a main body with a pistol handle extending from the lower portion. The main body has upper and lower passages extending through it in spacedparallel relationship. A ball with a bore is located in each passage and mounted for rotation about a horizontal axis passing through the center of the ball perpendicular to the axis of the bore. A lever is pivotally mounted at the upper portion of the main body for rotating each ball from an operative position (where the bore is aligned with its passage) to an inoperative position (where the bore extends at a right angle to its passage). Means is provided for connecting one end of each of the passages to one of two different fire fighting agents and a tube extends from the other end of each passage to serve as an exit for the agent.

More specifically, the two levers are mounted side-by-side on a common pivotal axis which extends horizontally and is coincidental with the axis of rotation of the upper ball, one of the levers being directly connected to that ball. The other lever is connected by a gear train to the lower ball. The levers have broad plates extending toward each other and have straight vertical edges that lie adjacent each other midway between the levers. Each ball is provided with laterally-extending journals which are carried in corresponding bores in the main body and a polymer seal is mounted in each passage in contact with its ball.

BRIEF DESCRIPTION OF THE DRAWINGS

The character of the invention, however, may be best understood by reference to one of its structural forms as illustrated by the accompanying drawings, in which.

DESCRIPTION OF THE PREFERRED EMBODIMENT

Figure 1:
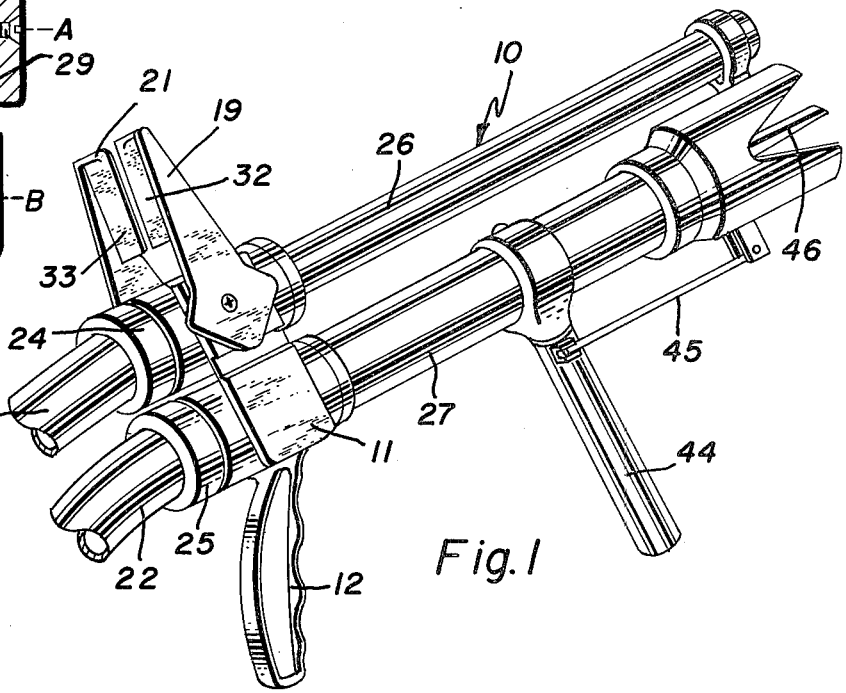
FIG. 1 is a perspective view of a fire fighting nozzle incorporating the principles of the present invention.

Referring first to FIG. 1, wherein are best shown the general features of the invention, the fire fighting nozzle, indicated generally by the reference numeral 10, is shown as having a main body 11 from the lower portion of which extends a pistol grip handle 12. On one side of the main body extend an upper and a lower exit tube 26 and 27. To the other side of the main body are attached hoses 22 and 23 which are connected to the main body by means of couplings 25 and 24, respectively. The hose 22 is connected to a source of foam under pressure, while the hose 23 is connected to a source of powder under pressure. Pivotally mounted to the upper portion of the main body 11 are two levers 19 and 21 provided with broad plates 32 and 33, respectively. Extending from the lower part of the lower tube 27 is a handle 44 which is joined by a connecting rod 45 to a regulating vane 46 at the exit end of the tube.

Figure 3:
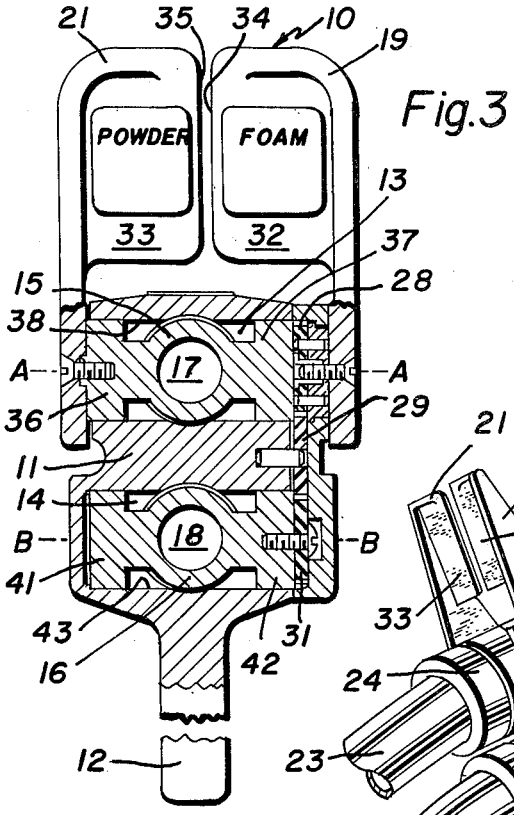
FIG. 3 is a sectional view of the nozzle taken on the line III—III of FIG. 2.
Figure 2:
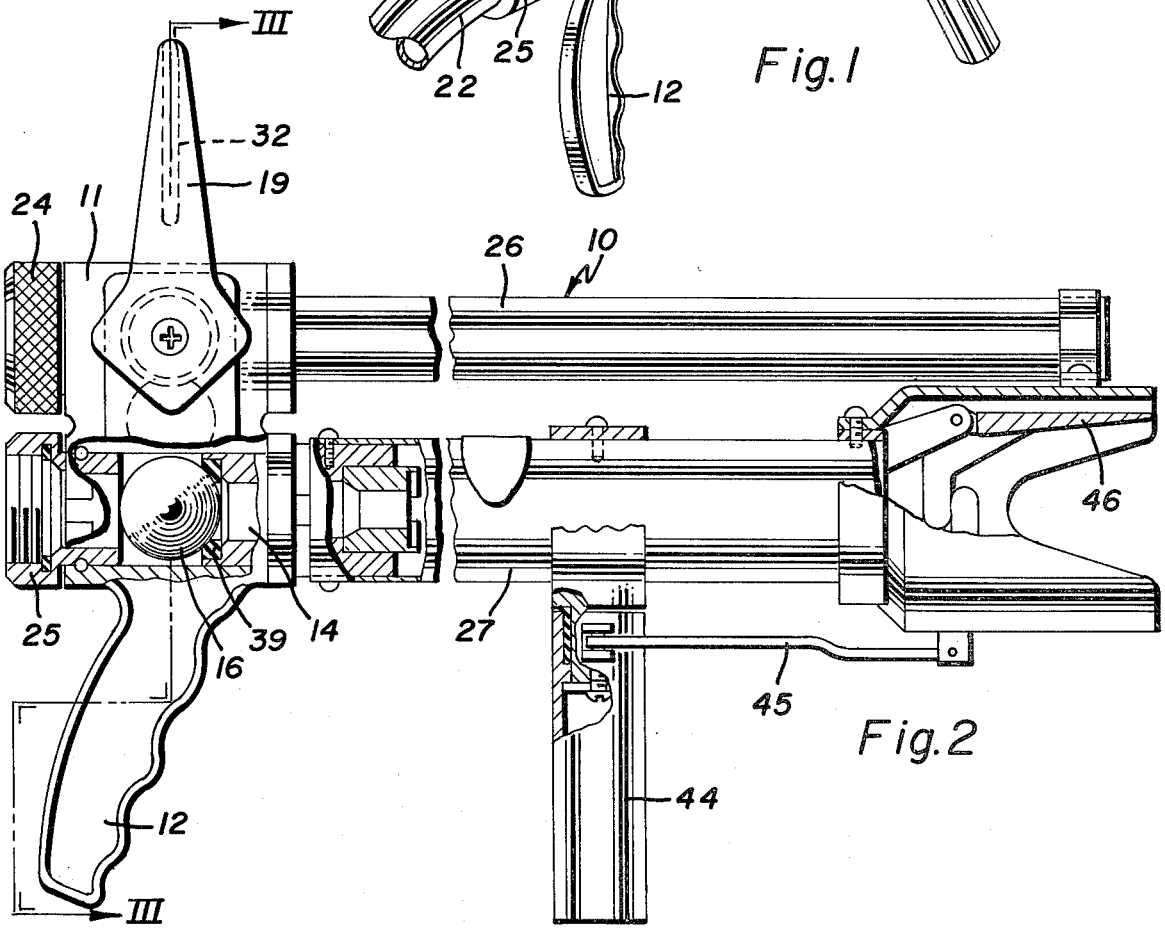
FIG. 2 is a side view of the nozzle with portions broken way.

In FIGS. 2 and 3 it can be seen that the main body 11 is provided with an upper passage 13 and a lower passage 14, these passages extending through the main body in spaced-parallel relationship. The passage 13 connects the coupling 24 to the tube 26 and the passage 14 connects the coupling 25 to the tube 27. A ball 15 is mounted in the passage 13, while a ball 16 is mounted in the passage 14. The ball 15 has a bore 17, while the ball 16 has a bore 18 extending through it, each bore having an axis which is co-incidental with the center of the ball. Each ball is mounted for rotation about its own horizontal axis passing through the center of the ball and perpendicular to the axis of its bore.

The lever 21, which is pivotally mounted at the upper portion of the main body 11, is directly connected to the ball 15 for rotating the ball from an "operative" position, wherein the bore 17 is aligned with the passage 13, to an "inoperative" position in which the bore is at a right angle to the passage. Similarly, the lever 19 is also pivotally mounted at the upper portion of the main body 11 and serves to rotate the ball 16 in the same way from an inoperative position to an operative position. The two levers are mounted in side-by-side position and are pivoted on a common pivotal axis A—A which extends horizontally at a right angle to the axis of the passage 13. More specifically, the pivotal axis A—A of the levers 19 and 21 is co-incidental with the axis of rotation of the upper ball 15 and the lever 21 is directly connected to that ball. The lever 19 is connected by a gear train, consisting of gears 28, 29, and 31 to the ball 16. The levers 19 and 21 are mounted on opposite sides of the main body 11 and extend upwardly therefrom. The lever 19 has a plate 32 extending inwardly thereof, while the lever 21 has a similar plate 32 extending inwardly. These plates have vertical edges 34 and 35, respectively, that lie in closely-spaced parallel relationship.

The ball 15 is provided with laterally-extending journals 36 and 37 which lie in a corresponding bore 38 which extends across the main body at a right angle to the passage 13. This journal consists of a large portion having a cylindrical surface provided with an O-ring carried in the bore and a smaller portion which joins it to the ball 15 itself. The ball 16 is similarly provided with journals 41 and 42 which lie in a bore 43 extending transversely across through the main body 11 at a right angle to the passage 14. The ball 16 is provided with a polymer seal 39 mounted in the passage 14 in contact with the ball and a similar seal (not shown) is provided for the upper ball 15.

The operation and the advantages of the invention will now be readily understood in view of the above description. During operation, pressurized foam appears at the hose 22 at all times and is transmitted through the coupling 25 and the passage 14 and bore 18 to the tube 27 on occasion. Similarly, pressurized powder appears in the hose 23 and can be transmitted through the coupling 24 and the passage 13 and bore 17 to the tube 26 when desired. When the levers 19 and 21 are in the rearmost position (shown out of positing in the drawings), the bores 17 and 18 are aligned with their passages 13 and 14, respectively, and the fire fighting agent passes through. When the lever 21 is rotated to its most forward position, the bore 17 is rotated out of alignment with the passage and no agent can flow through the exit tube 26. The lever 21 is securely fastened to the outer end of the journal 36, so that the journal and the ball 15 rotate with the handle. Similarly, the rotation of the lever 19 operates through the trains of gears 28, 29, and 31 to rotate the journal 42 and, consequently, the ball 16. This rotation causes the bore 18 to move out of alignment with the passage 14, so that agent cannot pass through into the tube 27. The broad surfaces of the plates 32 and 33 not only provide a suitable place for indicia to show the type of agent used, but also provide for secure grasping of the lever even when the operator's hands are slippery and act as a handle stop in the two directions. The normal operation of the nozzle would be to grasp it by the handle 12 with the right-hand and to operate the levers 19 and 21 with the left-hand. After the valves have been adjusted, the handle 44 is grasped with the left-hand, which is also capable of adjusting the shape of the foam stream by operating through the connecting rod 45 to move the vane 46.

It can be seen, then, that the present device involves very simple inexpensive equipment for accomplishing its purpose. The fact that the levers 19 and 21 extend upwardly from the upper part of the main body 11 provides for convenient control of the operation, allowing the operator to switch from one agent to another very readily or to operate with both agents together. The passages are large and extend straight through the apparatus, so that they are not easily subject to clogging. Furthermore, the parts can be readily disassembled for cleaning.

It is obvious that minor changes may be made in the construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Fire fighting nozzle, comprising:

(a) a main body having an upper and a lower passage extending therethrough in spaced-parallel relationship, (b) a ball located in each passage, each ball having a bore, the ball being mounted for rotation about a horizontal axis passing through the center of the ball perpendicular to the central axis of the bore, (c) means including two upwardly-extending levers pivotally mounted at the upper portion of the main body for rotating each of the balls from an operative position where the bore is aligned with its passage to an inoperative position where the bore is at a right angle to the passage, (d) means for connecting one end of each passage to one of two different pressurized agents, (e) a tube extending from the other end of each passage, and (f) a pistol grip handle extending from the lower portion of the main body, the two levers being mounted side-by-side and pivoted on a common pivotal axis extending horizontally at a right angle to the longitudinal axes of the passages, one lever being connected by a gear train to the lower ball, which gear train consists of a plurality of gears mounted on spaced, parallel axes.

2. Fire fighting nozzle as recited in claim 1, wherein the said pivotal axis is coincidental with the axis or rotation of the upper ball and one of the levers is directly connected to that ball.

3. Fire fighting nozzle as recited in claim 1, wherein the two agents are powder and foam.

4. Fire fighting nozzle as recited in claim 1, wherein the two levers are mounted on opposite sides of the main body and extend upwardly therefrom, the levers having broad plates extending toward each other and having edges that lie adjacent each other midway between the levers.

5. Fire fighting nozzle as recited in claim 1, wherein each ball is provided with laterally-extending journals consisting of a large portion having a cylindrical surface carried in the bore and a smaller portion joining it to the ball.

6. Fire fighting nozzle as recited in claim 1, wherein a polymer seal is mounted in the passage in contact with the ball.

* * * * *